US006925669B1

(12) United States Patent
Friedman et al.

(10) Patent No.: US 6,925,669 B1
(45) Date of Patent: Aug. 9, 2005

(54) SUPPORT CUSHION AND SYSTEM OF CUSHIONS

(75) Inventors: Louis Friedman, Atlanta, GA (US); Don Cohen, Richmond Hill (CA)

(73) Assignee: One Up Innovations, LLC, Atlanta, GA (US)

( * ) Notice: Subject to any disclaimer, the term of this patent is extended or adjusted under 35 U.S.C. 154(b) by 0 days.

(21) Appl. No.: 10/414,437

(22) Filed: Apr. 15, 2003

(51) Int. Cl.[7] ..... A47C 16/00
(52) U.S. Cl. ..... 5/657; 5/655.9
(58) Field of Search ..... 5/632, 630, 652, 5/655.9, 925, 657, 490

(56) References Cited

U.S. PATENT DOCUMENTS 3,713,620 A * 1/1973 Tkach ..... 248/678
4,171,549 A * 10/1979 Morrell et al. ..... 5/632
4,473,913 A * 10/1984 Ylvisaker ..... 5/657
4,630,323 A * 12/1986 Sage et al. ..... 5/657
4,635,306 A * 1/1987 Willey ..... 5/657
4,777,678 A * 10/1988 Moore ..... 5/657
4,905,330 A * 3/1990 Jacobs ..... 5/657
5,448,790 A * 9/1995 Saro et al. ..... 5/657
5,530,974 A * 7/1996 Rains et al. ..... 5/630
5,615,927 A * 4/1997 Kassai ..... 297/452.27
6,021,535 A * 2/2000 Baus et al. ..... 5/657
6,145,508 A * 11/2000 Seip, Jr. ..... 5/648
6,374,751 B1 * 4/2002 With ..... 108/43
6,578,217 B1 * 6/2003 Roberson ..... 5/632

* cited by examiner

*Primary Examiner*—Michael Safavi
(74) *Attorney, Agent, or Firm*—Smith, Gambrell & Russell, LLP

(57) ABSTRACT

The present invention provides a cushion and system of cushions with fabric coverings adapted to provide frictional contact between one or more additional similarly covered cushions for creating a wide variety of body support configurations.

10 Claims, 3 Drawing Sheets

SUPPORT CUSHION AND SYSTEM OF CUSHIONS

BACKGROUND OF THE INVENTION

The present invention relates to configurable cushions particularly adapted for comfortably supporting individuals in a variety of desired positions.

From sitting and sleeping to exercising and working, human activities depend on a wide variety of apparatuses for supporting individuals in desired positions. Well-known support devices include sofas, chairs, mattresses, mats, seat cushions, pillows, benches, bean bags, futons and many other types of furniture.

Specialized cushioned support devices are disclosed in U.S. Pat. No. 4,905,330 to Jacobs, U.S. Pat. No. 4,635,306 to Willey and U.S. Pat. No. 4,987,625 to Edelson. However, while such devices generally teach the use of resilient cushions in pre-determined configurations for particular purposes such as exercise, bronchial drainage, and floor support, respectively, such devices depend on interconnected cushion segments or limited useful contact positioning of separate cushion segments as required by the particular purpose. Accordingly, such devices provide limited adaptability and flexibility for creating a variety support configurations for many activities.

A need therefore remains for support cushions that may be stacked in a variety of configurations for supporting a variety of desirable positions depending on the activity. Further, there is a need for support cushions that may be configured for supporting multiple persons depending on the activity.

SUMMARY OF THE INVENTION

The present invention answers these needs by providing unfixed support cushions adapted for stacking into a variety of configurations for supporting one or more persons.

In an embodiment of the invention, a cushion having a high-density foam core is provided with an outer covering adapted for frictionally contacting a similar covering of one or more other cushions. In embodiments of the invention, the outer coverings include nylon micro-fibers. In such embodiments, the micro-fiber coverings interact with each other in the respective cushions to provide adjustable, stable body support configurations. Further, the micro-fiber coverings, unlike hook and loop material, for instance, provide excellent adherence between cushions, while remaining quiet during adjustment and soft to the touch. Micro-fiber coverings also allow each cushion to be covered in similar material, while hook and loop materials requires different complimentary surfaces. Accordingly, the present invention provides for a system of inter-compatible cushions that provide superior aesthetic and tactile characteristics over other "adhering" fabrics and surfaces.

It is object of the present invention to provide for cushions adapted for a variety of body support configurations, including, for example, therapeutic support of individuals having back, joint and other disorders, enhanced sexual intercourse positioning support, including support for those with medical disorders that limit sexual activity and/or facilitating conception, exercise positions, and as adjustable furniture for everyday activities such as watching television, playing video games, reading, tanning, and like desirable support positions.

It is a further object of the present invention to provide for independent, inter-compatible body support cushions in various shapes and sizes to support a wide variety of configurations for supporting not only individuals, but multiple persons. Various embodiments include triangular polyhedrons, or wedges, cubes, rectangular polyhedrons and the like. In certain embodiments, the shape and size of the cushions may also be customized for supporting particular portions of a body and/or particular activities.

DETAILED DESCRIPTION OF THE INVENTION

The present invention provides cushions adapted for supporting a person or multiple persons in stable, comfortable support configurations. Such configurations are freely adjustable into a variety of formations depending on the support activity.

Figure 1:
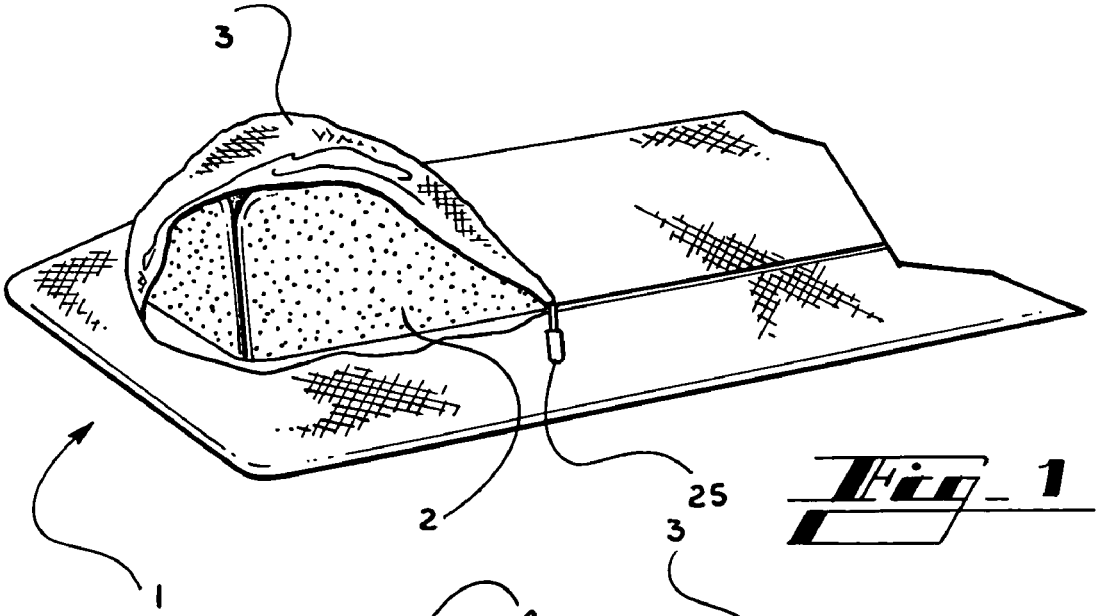
FIG. 1 is a side view of an opened, removable outer covering surrounding a core of a cushion in an embodiment of the present invention.

Referring to FIG. 1, a cushion 1 of the present invention is provided with a firm, spongy core 2 enclosed in an outer covering 3.

As the cushion is adapted for supporting not only individuals, but multiple persons, it will be appreciated that the inner core 2, while sponge-like, maintains its general shape under several hundred pounds of body weight.

In one embodiment of the invention, the inner core 2 comprises urethane or latex foam with a density rating of 1.8 to 2.0 (1.8 to 2.0 pounds of chemical in each cubic foot of foam material) and an indention load deflection (ILD) rating of 45 to 55 (the foam requires 45 to 55 pounds of pressure to condense the foam to 25 percent of its thickness).

The outer covering 3 is a fabric cover, preferably removable, for enclosing the core 2. Although it is not required that the outer covering 3 be removable, the disclosed embodiments provide for ease of removing and washing as desired.

Figure 2:
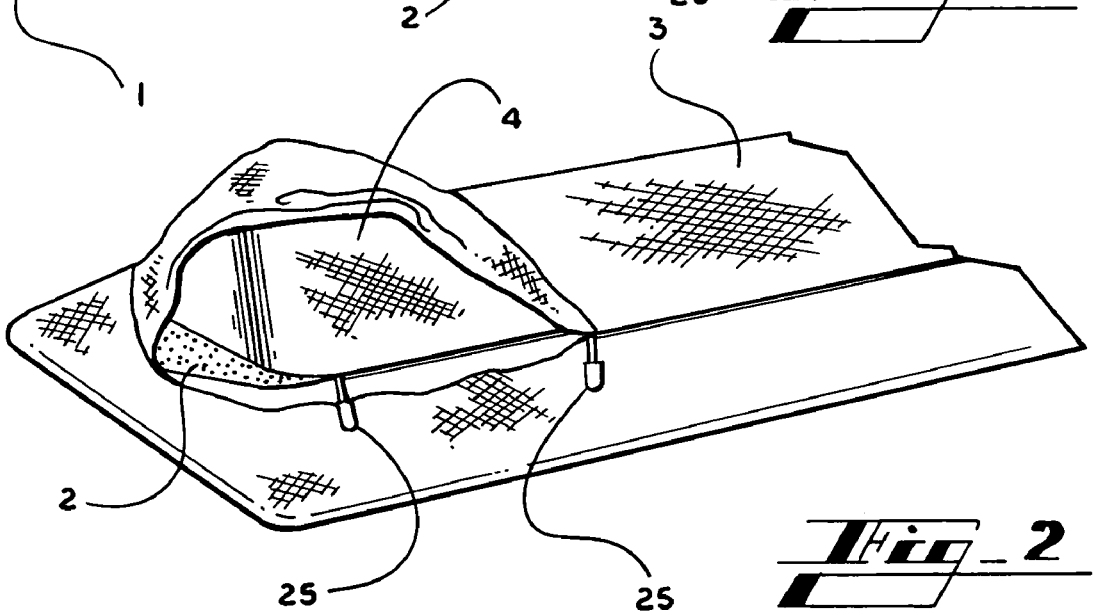
FIG. 2 is an opened side view of a cushion including a foam core, inner covering and outer covering in an embodiment of the present invention.
Figure 2A:
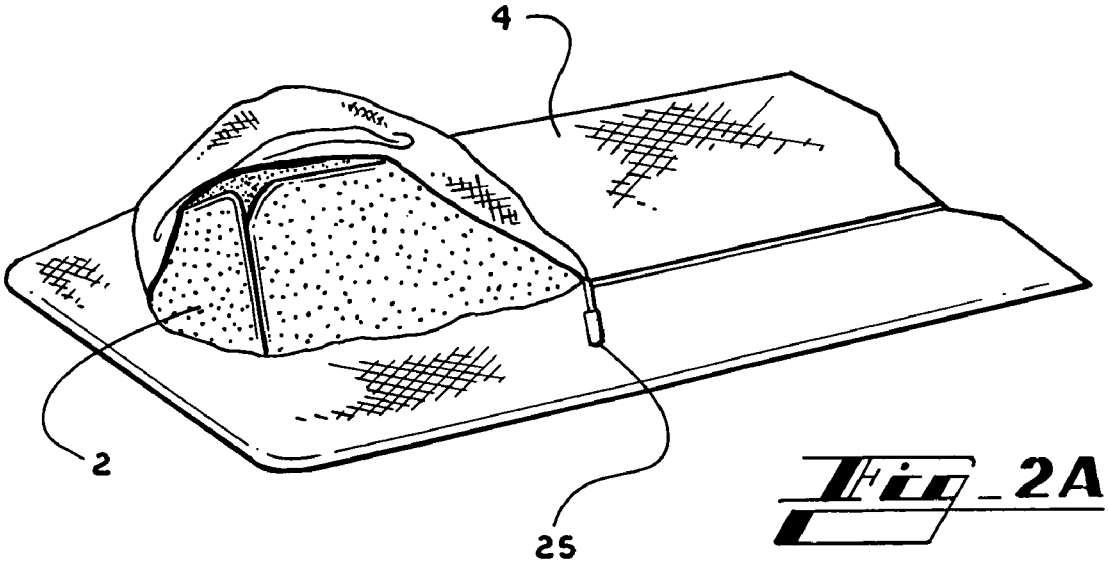
FIG. 2A is an opened side view of a cushion including a foam core and inner covering in an embodiment of the present invention.

With further reference to FIGS. 2 and 2A, in alternative embodiments, an inner covering 4 is provided for tightly containing the form core 2. In one such embodiment, the inner covering 4 is a removable nylon cover that tightly encases the core 2. The tight fit of the inner cover 4 around core 2 adds greater stability to the core 2, especially when multiple persons are supported by the cushion 1 during motion activities, such as intercourse. In further embodiments where the cushion of the present invention is adapted to support human motion, the inner covering 4 is provided with a tetrafluoroethylene coating (such as Teflon® coatings available from E. I. du Pont de Nemours and Company of Wilmington, Del.) to promote slippery action between the inner covering 4 and outer covering 3.

In other exemplary embodiments, the inner covering 4 and outer covering 3 are both removable, washable and stain-resistant. It will also be appreciated that in addition to the zippers 25 depicted in FIGS. 1, 2 and 2A, a variety of devices for removing coverings 3 and 4 may be provided in the invention, including buttons, hook and loop material, snaps, and the like.

Figure 8:
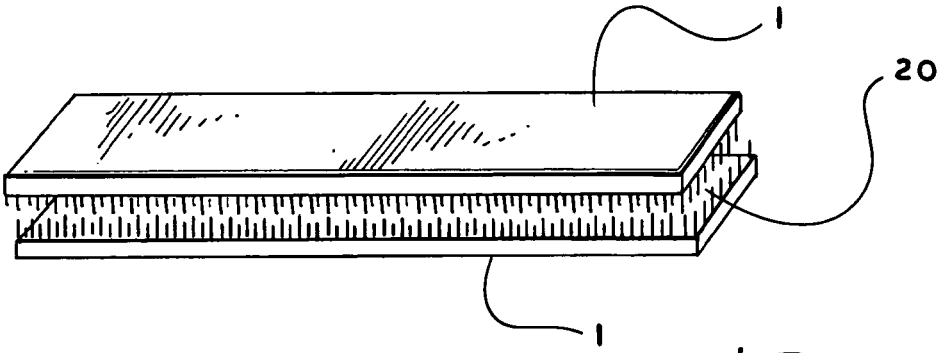
FIG. 8 is a magnified view of the uncompressed outer covering fibers between cushions in an embodiment of the present invention.
Figure 8A:
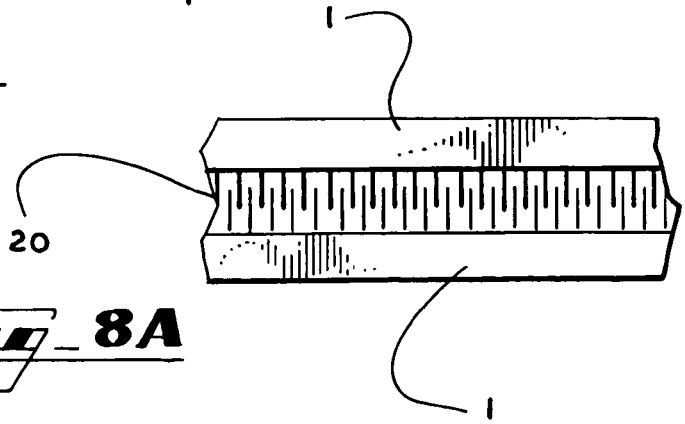
FIG. 8A is a partial view of the interaction of compressed outer covering fibers between cushions in an embodiment of the present invention.

With continuing reference to FIGS. 1, 2 and 2A, and further reference to FIGS. 8 and 8A, in embodiments of the present invention, the outer covering 3 is a soft fabric providing a comfortable feel to persons supported on the cushion 1.

In one embodiment of the invention, the outer fabric cover 3 surface is 100 percent nylon micro-fibers 20. In this embodiment, the fibers 20 are bonded by electrostatic process to a polyester-cotton osnaburg backing.

In a further embodiment of the present invention, the nylon micro-fibers 20 of the outer covering 3 are about 0.8 to 2.0 millimeters in length and about 1.0 to 3.0 Denier. In one embodiment, the fiber length is 1.0 mm and the thickness is 1.5 Denier. In alternative embodiments, the ratio of fiber length to thickness may be increased or decreased depending on the texture and adherence level desired between the fabrics. Typically, when the thickness (Denier) is increased, the fiber length is also increased to maintain desired frictional characteristics of the invention. However, products of the invention may exhibit less pleasant tactile characteristics with increasing fiber thickness and length.

The micro-fibers 20 of the outer fabric covering 3 of the present invention also return to an upright position following compression by a person's bodyweight upon the cushion 1. Similarly, the fibers return to their upright position following washings. Accordingly, the outer cover 3 of the cushion 1 is sturdy while maintaining a "soft" feel and vibrant appearance following both use and washings.

Figure 5:
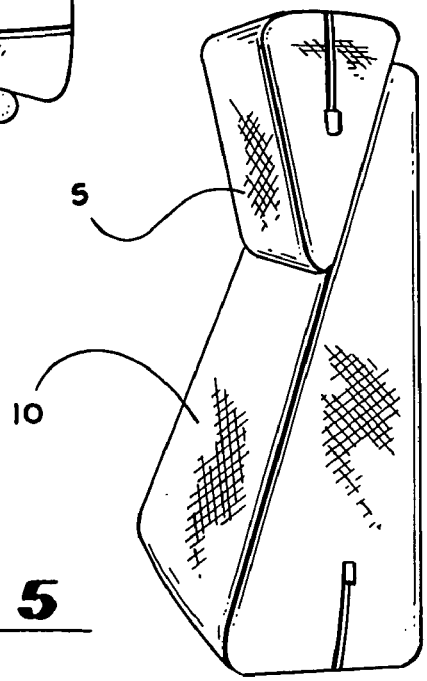
FIG. 5 is a perspective side view of a cushion support system depicted in a vertical (upright) embodiment of the present invention.

Referring to FIGS. 8 and 8A, the frictional interaction of micro-fibers 20 between two or more cushions 1 allows a plurality of cushions 1 to adhere to one another in a desired configuration. The adhering cushions 1 can stably support one or more persons in a variety of desired configurations. FIG. 8 illustrates the micro-fibers 20 in an uncompressed state, such as prior to body weight applied against one or more cushions 1. FIG. 8A illustrates the "nesting" interaction of the micro-fibers 20 when the fabric surfaces are compressed against one another, such as by applied body weight. The interaction of fibers 20 in a compressed state with applied weight enhances the adhesion between fibers 20 and cushions 1. However, as shown in FIG. 5, in various embodiments the cushions still adhere to one another in a vertical embodiment even without the application of body weight. Accordingly, while adhesion between the cushions 1 is enhanced by compression from body weight, the cushions 1 of the present invention provide for considerable frictional adhesion (such as overcoming gravity) when the fibers 20 of the outer coverings 3 are simply in contact with one another.

The fibrous fabric outer covering 3 of the cushions 1 also stably hold the cushions against one another in the desired configuration when subjected to the weight and/or motion of a person or persons. Accordingly, minimal (if any) repositioning is necessary during the use of the cushions.

Exemplary embodiments of one or more cushions provided in various configurations is illustrated in FIGS. 3–6. The disclosed shapes of a large triangular polyhedron 10, a small triangular polyhedron 5, a rectangular polyhedron 12 and a cube 8, are well-suited for allowing a wide variety of support configurations. However, it will be appreciated that while flat surfaces of polyhedrons better support most portions of a body, the present invention is not limited to the disclosed polyhedron shapes, and may include virtually any shape, including cylindrical, spherical, pyramidical, custom shapes, and the like, depending on the desired human support activity and configuration of cushions.

With continuing reference FIGS. 3–7, in embodiments of the present invention adapted for supporting individuals to permit (or enhance) sexual intercourse or to promote conception, the cushions may be provided commercially in a number of predetermined shapes and sizes that enable a wide variety of configurations with a minimal number of cushions. It will be appreciated that combinations of cushions may be provided in sets and/or individually, with all cushions provided with a fabric covering adapted for frictionally adhering to other cushions in desired support configurations.

In one embodiment where a pre-selected range of support cushions is provided for complimentary use to enable creating a wide variety of configurations from a limited number of cushions, exemplary cushions include the following: a large triangular polyhedron, or wedge-shaped cushion 10 that is 24 inches (or 30 inches for larger persons) wide×12 inches (or 14 inches for larger persons) tall×34 inches (or 36 inches for larger persons) long; a smaller wedge-shaped cushion 5 that is 24 inches wide (or 30 inches for larger persons)×7 inches tall×14 inches long; a large rectangular polyhedron 12 that is 24 inches wide (or 30 inches for larger persons)×9 inches tall×48 inches long; and an approximately cubic polyhedron 8 that is 20 inches wide×18 inches tall×18 inches long.

Figure 3:
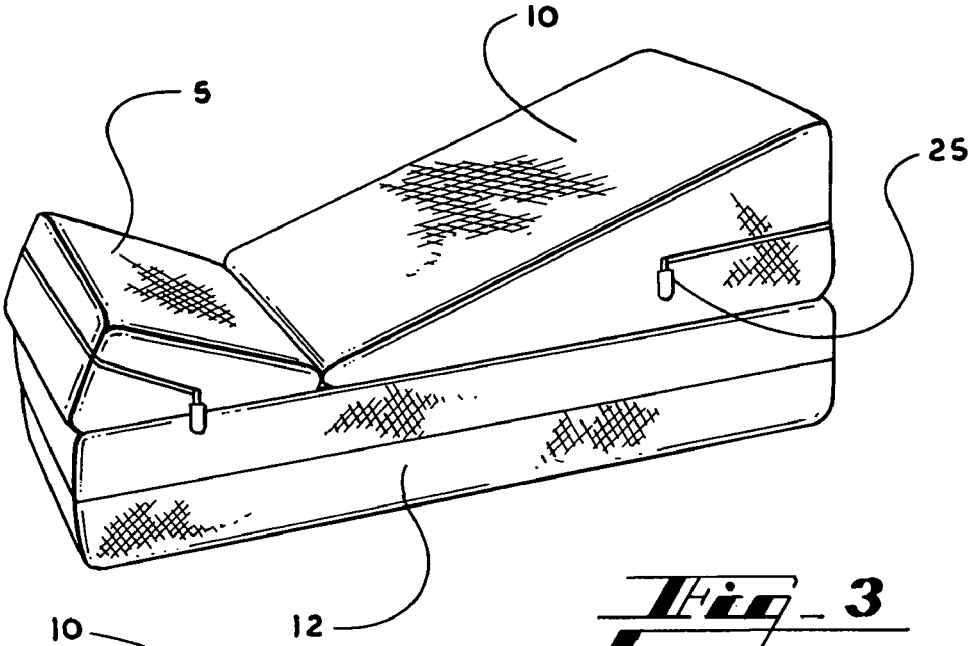
FIG. 3 is a perspective top view of a cushion support system depicting a plurality of cushion shapes and sizes in an embodiment of the present invention.
Figure 4:
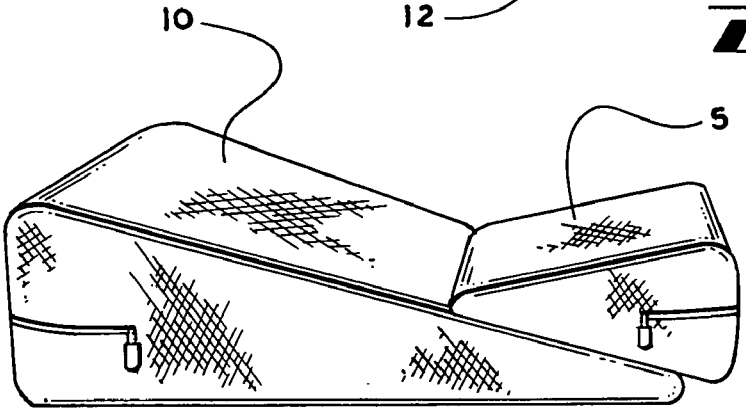
FIG. 4 is a perspective side view of a cushion support system depicted in a horizontal embodiment of the present invention.
Figure 6:
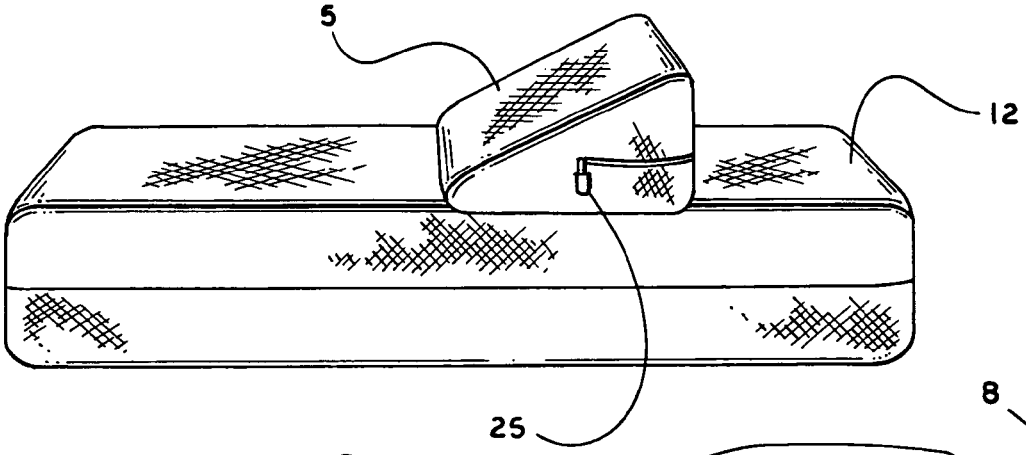
FIG. 6 is a perspective side view of a cushion support system depicted in an alternative horizontal embodiment of the present invention.
Figure 7:
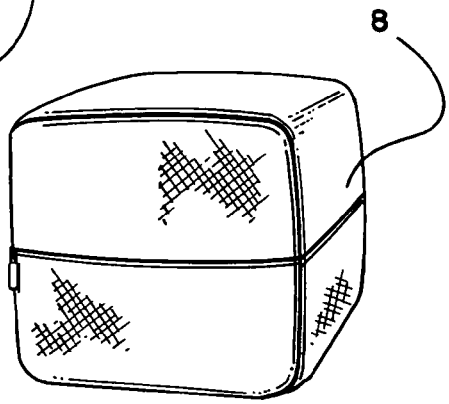
FIG. 7 is a front perspective view of a cube-shaped cushion in an embodiment of the present invention.

Referring to FIGS. 3–6, the cushions are adapted to permit individuals to combine multiple cushions in desired configurations for supporting one or more persons. FIGS. 3, 4 and 6 illustrate exemplary support horizontal configurations, such as along a floor, and FIG. 5 illustrates a vertical, or upright configuration demonstrating adhesion between the cushions. The vertical configuration provides for ease of storage in certain embodiments, such as where there is limited horizontal space in a closet.

Although some embodiments of the present invention have been described in detail hereinabove, all improvements and modifications to this invention within the scope or equivalence of the claims are intended to be included as part of this invention.

What is claimed is:

1. A support cushion system for providing bodily support to one or more persons comprising:

a first cushion including a resilient high-density foam core and a fabric covering; and a second cushion including a resilient high-density foam core and a fabric covering, wherein said second cushion is unfixed to the first cushion and the second cushion is adapted for supporting the first cushion in a stable body support configuration by the frictional contact between the coverings of the first and second cushions, and wherein the fabric coverings of each of said first and second cushions includes nylon micro-fibers having a length of about 0.8 to 2.0 mm and a thickness of about 1.0 to 3.0 denier.

2. The support cushion system of claim 1 wherein the micro-fibers of each of said first and second cushion coverings are about 1.5 denier and about 1 mm.

3. A body support cushion comprising:

a high-density foam core;

an inner cover tightly containing the foam core, wherein the inner cover stabilizes the foam core when supporting one or more persons, and wherein the inner cover includes tetrafluoroethylene-coated nylon; and an outer cover containing the inner cover and core, wherein the outer cover includes micro-fibers and is adapted for frictionally contacting one or more separate support cushions in adjustable, stable body support configurations.

4. The body support cushion of claim 3, wherein the outer cover is removable.

5. The body support cushion of claim 4, wherein the inner cover is removable.

6. The body support cushion of claim 3, wherein the inner cover is a non-stretch fabric.

7. A body support cushion comprising:

a high-density foam core;

an inner cover tightly containing the foam core, wherein the inner cover stabilizes the foam core when supporting one or more persons, and wherein the inner cover includes tetrafluoroethylene-coated nylon; and an outer cover containing the inner cover and core, wherein the outer cover is adapted for frictionally contacting one or more separate support cushions in adjustable, stable body support configurations.

8. A body support cushion comprising:

a high-density foam core;

an inner cover tightly containing the foam core, wherein the inner cover stabilizes the foam core when supporting one or more persons; and an outer cover containing the inner cover and core, wherein the outer cover is adapted for frictionally contacting one or more separate support cushions in adjustable, stable body support configurations and includes nylon micro-fibers having a length of about 0.8 to 2.0 mm and a thickness of about 1.0 to 3.0 denier.

9. The body support cushion of claim 8, wherein the micro-fibers are about 1.5 denier and about 1 mm.

10. A body support cushion comprising:

a high-density foam core;

a removable inner cover tightly containing the foam core, wherein the inner cover stabilizes the foam core when supporting one or more persons; and a removable outer cover containing the inner cover and core, wherein the outer cover is adapted for frictionally contacting one or more separate support cushions in adjustable, stable body support configurations.

* * * * *